US006265143B1

(12) United States Patent
Janssens et al.

(10) Patent No.: US 6,265,143 B1
(45) Date of Patent: Jul. 24, 2001

(54) PHOTOGRAPHIC MATERIAL FOR INDUSTRIAL APPLICATIONS

(75) Inventors: Eric René Janssens, Haacht; Gustaaf Joannes Peeters, Wilrijk, both of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/417,921

(22) Filed: Oct. 13, 1999

Related U.S. Application Data

(60) Provisional application No. 60/118,818, filed on Feb. 5, 1999.

(30) Foreign Application Priority Data

Nov. 23, 1998 (EP) ..... 98203952

(51) Int. Cl.[7] ..... G03C 1/005; G03C 1/035; G03C 1/76; G03C 1/795

(52) U.S. Cl. ..... 430/568; 430/523; 430/533; 430/948

(58) Field of Search ..... 430/7, 270.1, 568, 430/948, 600, 603, 523, 533

(56) References Cited

U.S. PATENT DOCUMENTS

| | | | | |
|---|---|---|---|---|
| 4,108,661 | * | 8/1978 | Vannassche et al. | 430/568 |
| 4,271,246 | * | 6/1981 | Sato et al. | 430/7 |
| 4,294,900 | * | 10/1981 | Aono | 430/7 |
| 4,386,143 | | 5/1983 | Sato et al. | 430/7 |
| 4,551,420 | | 11/1985 | Sugimoto et al. | 430/505 |
| 5,989,795 | * | 11/1999 | Evans et al. | 430/513 |

* cited by examiner

*Primary Examiner*—Janet Baxter
*Assistant Examiner*—Amanda C. Walke
(74) *Attorney, Agent, or Firm*—Joseph T. Guy; Hardaway/Mann IP Group

(57) ABSTRACT

A photographic material comprising a Lippmann emulsion coated on a polycarbonate support is disclosed. The product is suited for new industrial applications under severe conditions of temperature and humidity.

6 Claims, No Drawings

PHOTOGRAPHIC MATERIAL FOR INDUSTRIAL APPLICATIONS

This appln claims the benefit of Provisional No. 60/118,818 filed Feb. 5, 1999.

FIELD OF THE INVENTION

The present invention relates to an improved photographic material of the Lippmann emulsion type for industrial applications.

BACKGROUND OF THE INVENTION

So-called Lippmann emulsions having an average grain size of less than 0.1 μm (100 nm) are of particular importance for the preparation of photographic plates or films with high resolution for use in microphotography, for recording nucleophysical phenomena, for the preparation of masks in the production of microelectronic integrated circuits, for use in holography, for high density storage, etc.

In the production of microelectronic integrated circuits drawings are made, optionally on a highly enlarged scale, of the various successive masks necessary to produce one integrated circuit whereupon the drawings are reduced, if necessary in successive steps, and reproduced on a photographic plate or film material forming thereby the mask ready for use. By various photographic and and chemical steps (photo-etching of laquered plates) the images of the masks thus produced are transferred to the surface on which the integrated circuit is to be made, in order to produce the required circuit elements. In recent times several of the preliminary steps are reproduced digitally.

The photographic materials for use in the production of masks as described above should have a high resolving power and acutance and allow a correct reproduction of the dimensions of the image. Unless the dimensional reproduction is kept within the accepted tolerances the maks will be useless because it will not enable electronic components to be formed in the circuitry with the required degree of accuracy. Developments in the field of computer and telecommunication systems create the need for ever increasing packing densities on the circuit elements and therefore it has become common practice to reproduce image details e.g. lines and slits having widths even smaller than the emulsion thickness e.g. smaller than 5 μm. These image details should be reproduced within the accepted width tolerances of at most 10% respective to the original width.

Old patents dealing with the type of material described above are e.g. U.S. Pat. Nos. 3,652,280, 4,148,647, 4,108,661, and DE 2002062.

Materials and corresponding processing chemicals usable in the applications as explained above are marketed by Agfa-Gevaert N.V. under the trade name MILLIMASK.

Now recently new applications for this type of material have been invented by us that pose high requirements to the material concerning resistance to mechanical and thermal deformation. This is the case when the material is used under so-called "heavy duty" circumstances such as high temperature, extreme humidity, fast changes in temperature or humidity, or high mechanical stress. Under these circumstances the conventional supports for this type of material such as glass or polyethylene terephthalate and acrylic plates behave unsatisfactory.

OBJECTS OF THE INVENTION

It is an object of the present invention to provide a Lippman-type photographic material with improved dimensional stability under heavy duty circumstances such as high temperature, extreme humidity, fast changes in temperature or humidity, or high mechanical stress.

It is a further object of the present invention to provide new applications for this type of material.

SUMMARY OF THE INVENTION

The objects of the present invention are realized by providing a photographic material comprising a transparent polycarbonate support and at least one silver halide emulsion layer comprising a Lippmann emulsion having an average grain size smaller than 0.1 μm.

DETAILED DESCRIPTION OF THE INVENTION

In a most preferred embodiment the polycarbonate film used as support is the aromatic polycarbonate based on bisphenol A as recurring unit. This is the world-wide most used polycarbonate film for industrial applications. This type of polycarbonate film shows following excellent physical and mechanical characteristics which make it most suitable as support for the photographic materials of the present invention:

- good machinability: cutting (band or circular sawing, drilling, turning, routing, tapping, threading, . . .
- excellent optical transmission properties:
  - light transmission: 90%
  - haze: 0.5%
  - refractive index: 1.586
- temperature behaviour:
  - coefficient of thermal expansion: 70 μm/m° C.
  - heath conductivity: 0.20 W/m° C.
    - i.e. polycarbonate adapts fast (in minutes) to temperature changes;
- humidity behaviour:
  - coefficient of relative humidity expansion: about 0 μm/m % RH;
  - water absorption after 24 h: 0.035%
  - water absorption after 7 days: 0.35%
  - polycarbonate adapts slowly (several days) to relative humidity changes;
- specific gravity: $1.20\times10^3$ kg/m$^3$;
- tensile heat distortion at 50 psi: 134° C. or higher for particular types;
  - i.e. PC can be used in heavy duty circumstances;
- printing possible;
- cementing possible;
- image protection: waxing or lamination.

Polycarbonate film can be manufactured in several thicknesses. For use in connection with the present invention thicknesses of 400 μm or of 1.5 mm are preferred depending on the particular application.

For use in the present invention the polycarbonate film is preferably provided with a subbing layer. An example of a suitable subbing layer is based on a combination of colloidal silica, gelatin and resorcine.

The halide composition of the silver halide Lippmann emulsions used in accordance with the present invention is not specifically limited and may be any composition selected from e.g. silver chloride, silver bromide, silver iodide, silver chlorobromide, silver bromoiodide, and silver chlorobromoiodide. In a prefered embodiment however the Lippmann emusion is a iodobromo emulsion containing at least 90% of bromide. In the most preferred embodiment the emulsion consists of 97% of bromide and 3% of iodide.

The photographic emulsion(s) can be prepared from soluble silver salts and soluble halides according to different methods as described e.g. by P. Glafkidès in "Chimie et Physique Photographique", Paul Montel, Paris (1967), by G. F. Duffin in "Photographic Emulsion Chemistry", The Focal Press, London (1966), and by V. L. Zelikman et al in "Making and Coating Photographic Emulsion", The Focal Press, London (1966). They can be prepared by mixing the halide and silver solutions in partially or fully controlled conditions of temperature, concentrations, sequence of addition, and rates of addition. The silver halide can be precipitated according to the single-jet method, the double-jet method, the conversion method or an alternation of these different methods.

The emulsion can be desalted in the usual ways e.g. by dialysis, by flocculation and re-dispersing, or by ultrafiltration.

The light-sensitive silver halide emulsions are preferably chemically sensitized as described e.g. in the above-mentioned "Chimie et Physique Photographique" by P. Glafkidès, in the above-mentioned "Photographic Emulsion Chemistry" by G. F. Duffin, in the above-mentioned "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodamines. The emulsions can be sensitized also by means of gold-sulphur ripeners, gold-selenium ripeners or by means of reductors e.g. tin compounds as described in GB 789,823, amines, hydrazine derivatives, formamidine-sulphinic acids, and silane compounds. Chemical sensitization can also be performed with small amounts of Ir, Rh, Ru, Pb, Cd, Hg, Tl, Pd, Pt, or Au. One of these chemical sensitization methods or a combination thereof can be used.

The light-sensitive silver halide emulsions can be spectrally sensitized with proper dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. In the preferred embodiment of the present invention the emulsion is orthochromatically sensitized.

The silver halide emulsion(s) for use in accordance with the present invention may comprise compounds preventing the formation of fog or stabilizing the photographic characteristics during the production or storage of photographic elements or during the photographic treatment thereof. Many known compounds can be added as fog-inhibiting agent or stabilizer to the silver halide emulsion. Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB 1,203,757, GB 1,209,146, JA-Appl. 75-39537, and GB 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide. Other compounds that can be used as fog-inhibiting compounds are metal salts such as e.g. mercury or cadmium salts and the compounds described in Research Disclosure No 17643 (1978), Chapter VI.

The fog-inhibiting agents or stabilizers can be added to the silver halide emulsion prior to, during, or after the ripening thereof and mixtures of two or more of these compounds can be used.

Besides the silver halide another essential component of a light-sensitive emulsion layer is the binder. The binder is a hydrophilic colloid, preferably gelatin. Gelatin can, however, be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents or by grafting of polymerizable monomers on gelatin, and cellulose derivatives such as hydroxyalkyl cellulose, carboxymethyl cellulose, phthaloyl cellulose, and cellulose sulphates.

The binders of the photographic element, especially when the binder used is gelatin, can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts as disclosed in U.S. Pat. No. 4,063,952.

The photographic material of the present invention may further comprise various kinds of surface-active agents in the photographic emulsion layer or in another hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Other suitable surfactants include perfluorinated compounds.

Beside the light sensitive emulsion layer(s) the photographic material can contain several non light sensitive layers, e.g. an anti-stress top layer, one or more backing layers, and one or more intermediate layers optionally containing filter- or antihalation dyes that absorb scattering light and thus promote the image sharpness. Suitable light-absorbing dyes of the oxonol type are disclosed e.g. in GB 506385—515998—646123—646125—619544— 933466. Suitable light absorbing dyes of the arylidene type are described in e.g. GB 396646, FR 1570870, and BE 716661. Light-absorbing dyes of the triarylmethane type are described e.g. in GB 446583 and GB 790023. Other suitable light-absorbing dyes are described in U.S. Pat. Nos. 4,092,168, 4,311,787 and DE 2,453,217.

One or more backing layers can be provided at the non-light sensitive side of the support. However, in the preferred embodiment of the present invention the photographic material contains no extra anthalation layer and the light-absorbing dye(s) is (are) incorporated in the emulsion layer itself.

The photographic material in connection with the present invention may further comprise various other additives such as e.g. compounds improving the dimensional stability of the photographic element, UV-absorbers, and plasticizers.

Suitable additives for improving the dimensional stability of the photographic elements are e.g. dispersions of a water-soluble or hardly soluble synthetic polymer e.g. polymers of alkyl(meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, α-β-unsaturated dicarboxylic acids, hydroxyalkyl (meth)acrylates, sulphoalkyl (meth)acrylates, and styrene sulphonic acids.

The photographic materials of the present invention can be exposed in contact, in optical systems, in a pattern generator or in a step and repeat camera.

The described Lippmann-type materials can be processed by the negative type of processing and by the reversal type of processing. The developing solutions are conventionally based on hydroquinone as main developing agent. An auxiliary second developer such as N-methyl-aminophenol (Metol) or a 3-pyrazolidone derivative may be present. Derivatives of 3-pyrazolidone for use as second developing agent include 1-phenyl-3-pyrazolidone (commonly designated as "Phenidone"), 1-phenyl-4-monomethyl-3-pyrazolidone, 1-phenyl-4,4'-dimethyl-3-pyrazolidone and 1-phenyl-4-hydroxymethyl-4'-methyl-3-pyrazolidone.

The developing and replenishing solutions preferably further contain an anti-fogging agent. Many known compounds can be added as fog-inhibiting agent or stabilizer to a processing solution. Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptopyrimidines, mercaptotriazines, benzothiazoline-2-thione and oxazolinethione. Other classes include triazolopyrimidines such as those described in GB 1,203,757, GB 1,209,146, JA-Appl. 75-39537, and GE 1,500,278 and other compounds such as benzenethiosulphonic acid, benzenethiosulphinic acid and benzenethiosulphonic acid amide compounds. A preferred compound for use in accordance with the present invention is 1-phenyl-5-mercaptotetrazole.

The developing and replenishing solutions for use in accordance with the present invention preferably further contain a compound providing halide ions as development rate regulator, most preferably sodium or potassium bromide in a concentration between 0.01 and 0.2 mole/liter. Further sulphite ions, preferably provided as an alkali sulphite, are preferably present as antioxidant in a concentration between 0.1 and 0.5 mole/liter.

The alkali agent is preferably sodium or potassium hydroxide.

The developing and replenishing solutions for use in accordance with the present invention further contain buffering agents. Suitable buffer systems include carbonate buffer, phosphate buffer, metaborate buffer, etc. The concentration of these buffering agents is preferably about 0.4 mole/liter.

Other adjuvants well known to those skilled in the art can be incorporated into the developer solution. A survey of conventional developer addenda is given by Grant Haist in "Modern Photographic Processing"—John Wiley and Sons—New York (1979) p. 220–224. Examples of such addenda include complexing agents for calcium and magnesium ions, present in hard water, e.g. ethylene diamine tetraacetic acid and analogous compounds. Further can be present anti-foaming agents, surface-active agents, biocides, thickening agents like polystyrene sulphonate and antioxidants like benzoate and cyclodextrine. The developing liquid can contain so-called anti-sludge agents in order to reduce dirt streaks on developed photographic material. Finally the solution can contain development accelerating agents like polyalkyleneoxides and alkonolamines and hardening agents including latent hardeners.

Negative processing involves development, washing, fixing, washing and drying. Reversal processing typically involves following steps: first development, washing, bleaching, washing, clearing, washing, second overall exposure, second development, washing, fixing, washing and drying.

Finished images, obtained after exposure and processing of the Lippmann type material of the present invention, and carrying specific predefined image patterns are used in a number of old and new applications. Some of the new applications require high dimensional stability under heavy duty circumstances. Examples of these applications include:

- pulse disk for the precise measurement of rotational velocities. A new application of this principle is e.g. in the ABS brake systems of automobiles. This is a typical example of a "heavy duty" circumstance;
- in other types of velocity and position control systems;
- in code wheels and rulers;
- in so-called optical targets, e.g. in balances in grocery stores;
- in liquid crystal displays;
- as master image for optical ganging and instrumentation;
- all types of illuminated instruments, panels and control boards, e.g. in transport means;
- light attenuation in instrumentation;
- edge lighted ad displays;
- name plated, templates and lay-outs;
- computer code disks The present invention will now be illustrated by the following examples without however being limited thereto.

EXAMPLES

Example 1

The emulsion grains were prepared as follows. A solution of silver nitrate on the one hand and a solution of a mixture of 97% of potassium bromide and 3% of potassium iodide on the other hand were added simultaneously according to the double jet principle to an aqeous gelatin solution. The resulting emulsion was washed by means of ultrafiltration. The average grain size was about 0.08 μm. The emulsion was chemically sensitized by means of conventional S—Au ripening agents. After completing the chemical sensitization following ingredients were added to the liquid emulsion:

a green spectral sensitizer according to following formula:

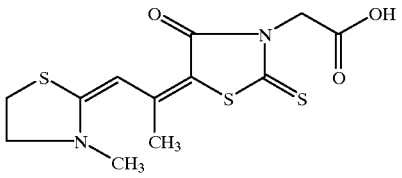

a light-absorbing dye for acutance and antihalation according to following formula:

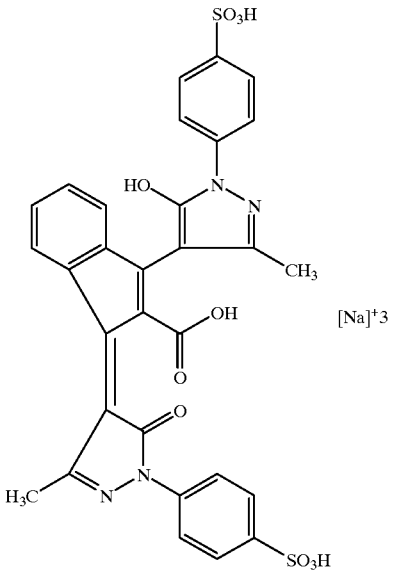

a second light-absorbing dye accrding to following fomula:

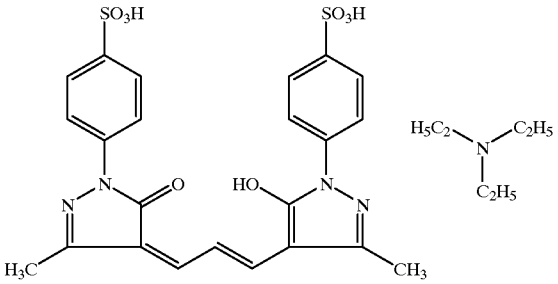

a stabilizer according to following formula:

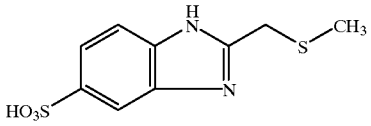

a second stabilizer according to following formula:

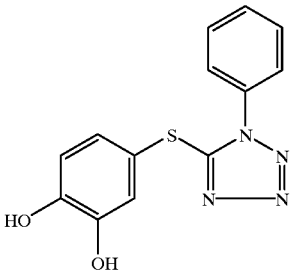

5-nitroindazole

The finished emulsion was coated by means of the slide hopper technique on a bisphenol A based polycarbonate film of 400 μm thickness at a silver coverage of 4.5 g/m$^2$, expressed as $AgNO_3$, and dried.

A sample of the obtained photographic material was exposed with a test pattern comprising line patterns, dots, and a sensitometric wedge.

The photographic sample was subjected to a negative processing according to following specifications:

development: 4 min in a conventional developer based on hydroquinone;

wash: 2 min in running water;

fixing: 2 min in a conventional ammonium thiosulphate containing fixer;

10 min of washing in running water and drying.

An image with excellent image characteristics was obtained: high contrast, excellent line sharpness, very fine grain, exact reproduction of line width, no pinholes, resolution of 50000 dpi.

Example 2

A similar photographic sample prepared and exposed as in example 1 was subjected to a reversal processing according to following specifications:

development: 6 min in a conventional hydroquinone based developer;

wash: 2 min in running water;

bleach: 2 min in a solution containing potassium bichromate and sodium bisulphate wash: 2 min in running water;

clearing: 3 min in a solution containing sodium sulphite and Calgon;

second overall exposure by means of a 500 Watt incandescent lamp at 70 cm from the sample;

4 min second development in a conventional hydroquinone based second developer;

wash: 2 min in running water fixing: 2 min in a conventional ammonium thiosulphate containing fixer;

10 min of washing in running water and drying.

Again, an image with excellent image characteristics was obtained: high contrast, excellent line sharpness, very fine grain, exact reproduction of line width, no pinholes, resolution of 50000 dpi.

What is claimed is:

1. A photographic material comprising a transparent polycarbonate support, wherein said polycarbonate has a subbing layer comprising gelatin, resorcine, and colloidal silica, and at least one silver halide emulsion layer comprising a Lippmann emulsion having an average grain size smaller than 0.1 $\mu$m.

2. The photographic material according to claim 1, wherein the Lippman emulsion is an iodobromo emulsion containing at least 90% bromide.

3. The photographic material according to claim 2, wherein the iodobromo emulsion contains 97% bromide and 3% iodide.

4. A method for obtaining a photographic image comprising (a) exposing image-wise to a predefined pattern, and (b) subjecting to a negative processing, a photographic material comprising a transparent polycarbonate support, wherein said polycarbonate has a subbing layer comprising gelatin, resorcine, and colloidal silica, and at least one silver halide emulsion layer comprising a Lippmann emulsion having an average grain size smaller than 0.1 $\mu$m.

5. The method according to claim 4, wherein the Lippman emulsion is an iodobromo emulsion containing at least 90% bromide.

6. The method according to claim 5, wherein the iodobromo emulsion contains 97% bromide and 3% iodide.

* * * * *